US006012365A

United States Patent [19]

Dufour et al.

[11] Patent Number: 6,012,365

[45] Date of Patent: Jan. 11, 2000

[54] REDUCED MAINTENANCE CUTTING MACHINE

[75] Inventors: Charles Henry Dufour; Kevin Lauren Cote, both of Durham, N.H.

[73] Assignee: Heidelberger Druckmaschinen AG, Heidelberg, Germany

[21] Appl. No.: 09/062,916

[22] Filed: Apr. 20, 1998

[51] Int. Cl.[7] ..... B26D 1/00; B26D 7/06

[52] U.S. Cl. ..... 83/13; 83/37; 83/321; 83/324; 83/347; 83/481; 83/508.1; 83/658; 83/954

[58] Field of Search ..... 83/288, 287, 304, 83/305, 321, 328, 333, 346, 347, 348, 349, 481, 508, 508.1, 658, 663, 954, 13, 37

[56] References Cited

U.S. PATENT DOCUMENTS

| | | | |
|---|---|---|---|
| 947,100 | 1/1910 | Fuller | 83/348 |
| 3,354,921 | 11/1967 | Elsner | 83/327 |
| 3,483,780 | 12/1969 | Hudson | 83/348 |
| 3,495,491 | 2/1970 | Nungesser et al. | 83/348 |
| 3,521,514 | 7/1970 | Fiezell | 83/347 |
| 4,930,383 | 6/1990 | Kobler | 83/346 |
| 5,259,283 | 11/1993 | Michalik | 83/348 |

FOREIGN PATENT DOCUMENTS

| | | | |
|---|---|---|---|
| 1114982 | 4/1956 | France | 83/348 |

*Primary Examiner*—M. Rachuba
*Attorney, Agent, or Firm*—Kenyon & Kenyon

[57] ABSTRACT

An apparatus for cutting, including an anvil cylinder which may have a plurality of cut rubbers strips affixed around the anvil cylinder and a cut cylinder which is mounted for rotation about an eccentric axis. Two knife boxes may be mounted on the cut cylinder, each knife box having a knife and cheekwood for securing the knife to the cut cylinder. A paper tape guides the material to be cut between the cut cylinder and the anvil cylinder. When one knife box degrades, a knife sleeve on the cut cylinder can be indexed so that the other knife box takes the place of the degraded knife box. When a cut rubber strip degrades, the anvil cylinder can be indexed so that another cut rubber strip takes the place of the degraded cut rubber strap. Either of these functions can occur while the apparatus is still running. The anvil cylinder can also use a cut rubber sleeve.

13 Claims, 3 Drawing Sheets

REDUCED MAINTENANCE CUTTING MACHINE

BACKGROUND OF THE INVENTION

1. Field of the Invention

The present invention is directed to an apparatus and method for cutting a sheet of material. More specifically, the present invention relates to a method and apparatus for cutting paper, where a degraded knife, cheekwood, or cut rubber can be replaced without stopping the running of the cutting machine.

2. Description of the Prior Art

Cutting machines for cutting material, and in particular a web of paper, are known in the prior art. Such cutting machines normally use a knife blade which is surrounded by cheekwoods. Cheekwoods are blocks of material on either side of the knife blade which hold the knife blade in place and which contact a cut rubber against which the knife blade cuts. Directly opposite the knife blade in prior art cutting machines is a cut rubber. A cut rubber is a strip of rubber or other resilient material which the knife blade contacts after it has cut through the paper, and against which the paper is cut by the knife blade. The paper is passed between the knife blade/cheekwoods and the cut rubber, and the knife blade is moved toward and away from the paper and cut rubber. Each time the knife blade moves toward the paper and cut rubber, it cuts the paper. When the knife blade moves away from the paper and cut rubber, the paper is advanced to provide a new portion of the paper for cutting.

Such prior art industrial machines designed to cut large quantities of paper in a short time require frequent maintenance because their knives, cheekwoods, and/or cut rubbers degrade from constant use. Attempts have been made to improve the materials, geometry, and cutting dynamics of the knives, cheekwoods, and/or cut rubbers in prior art cutting machines, so as to reduce their frequency of maintenance. Even with these improvements, however, maintenance of a knife, cheekwood, or cut rubber is inevitable. When such maintenance is necessary, it has been required in prior art machines to stop the machine to replace or repair the worn part, causing delay in the paper cutting process.

SUMMARY OF THE INVENTION

The present invention is directed to an apparatus and method for cutting material, in particular paper, that allows the apparatus to continue to run even though some of its key parts have degraded. Paper is fed, using one or more tapes, between an anvil cylinder and a cut cylinder. The anvil cylinder includes a plurality of cut rubber strips located on the outer surface of the anvil cylinder in approximately equally spaced circumferential intervals, or the anvil cylinder can include a cut rubber surface in the form of a sleeve extending around the outer circumference of the anvil cylinder. The anvil cylinder is positioned so that one of the cut rubber strips, or a portion of the cut rubber sleeve, is as close to the cut cylinder as possible. This cut rubber strip is referred to as the primary cut rubber strip; the other cut rubber strips are referred to as reserve cut rubber strips. The anvil cylinder may be connected to an advancing or indexing mechanism for advancing a cut rubber strip or a portion of the cut rubber sleeve to a cutting position.

The cut cylinder includes a primary knife box and at least one reserve knife box located on the outer surface of the cut cylinder. The knife boxes may be located on opposite sides of the cut cylinder. The knife boxes may be composed of a knife blade surrounded on both sides by cheekwood, such that the cheekwood secures the non-cutting end of the knife in the cut cylinder. The knife boxes may be mounted on a knife sleeve, which is mounted for rotation on the cut cylinder. The knife sleeve may be connected to an advancing or indexing mechanism for advancing a knife box into a cutting position on the cut cylinder.

The normal operation of the anvil and cut cylinders occurs as the paper tape feeds the paper between the anvil cylinder and the cut cylinder. The cut cylinder circumferentially rotates, at constant intervals, eccentrically about an axis spaced from center of the cut cylinder. The anvil cylinder is held stationary. As the cut cylinder rotates, the knife in the primary knife box moves down to cut the paper threaded between the cut cylinder and the anvil cylinder. While the knife is cutting the paper, the knife also engages the opposing primary cut rubber strip or a portion of the cut rubber sleeve on the anvil cylinder. The threaded paper is thus cut at constant intervals depending, in part, on the rate of the rotational speed of the cut cylinder and the rate at which paper is fed between the anvil and cut cylinder. Because the cut cylinder circumferentially rotates eccentrically about a point spaced from the center of the cylinder, the knife from the reserve knife box does not cut the paper and does not engage the primary cut rubber of the anvil cylinder.

Eventually, the knife or cheekwood of the primary knife box will degrade. When this occurs, a knife sleeve, containing the primary and reserve knife boxes, on the outer circumference of the cut cylinder, can be rotated by one half of a revolution. This rotation can be accomplished with the cutting machine stopped, or while the cutting machine is running; if indexing occurs while the machine is running, indexing will occur between cuts, when the cut cylinder is disengaged from the anvil cylinder. Once this is accomplished, the knife from the reserve knife box will cut the paper threaded between the cut cylinder and the anvil cylinder and engage the opposing primary cut rubber on the anvil cylinder during each revolution of the cut cylinder. This allows the machine to continue operation, without costly interruption, until both knife boxes have degraded.

Because the anvil cylinder is stationary through the paper cutting process, the same cut rubber strip affixed to the anvil cylinder engages the knife affixed to the cut cylinder upon each complete rotation of the cut cylinder. Eventually, this cut rubber strip will also degrade. When this occurs, the anvil cylinder can be advanced or indexed such that one of the reserve cut rubber strips, or a new portion of the cut rubber sleeve, is in position to engage the knife box affixed to the cut cylinder upon each complete rotation of the cut cylinder. The degree of the index of the anvil cylinder depends on the number of cut rubber strips placed around the anvil cylinder, or the amount the cut rubber sleeve must advance to remove the degraded portion of the cut rubber sleeve. This rotation can be accomplished with the cutting machine stopped or on the run; indexing will occur between cuts, when the cut cylinder is disengaged from the anvil cylinder. The reserve cut rubber strip then performs the function of the original cut rubber strip. The process of replacing cut rubber strips can be repeated while the machine is running until all such strips have degraded. The degraded reserve cut rubber strips can also be replaced while the machine is running.

In another embodiment of the present invention, a band saw blade is installed on the cut cylinder in place of the two knife boxes. A band saw blade supplying post is fixed at one end the cylinder and a band saw blade receiving post is fixed at the other end of the cylinder. A band saw blade is wound around both posts and a tensioning apparatus is used to keep the band saw blade taught. The band saw blade runs down the length of the outside of the cylinder approximately parallel to the cylinder's axis. Initially, most of the band saw blade is wound around the supplying post. The band saw blade serves the same function as the knife boxes in cutting the paper and engaging the cut rubber strips of the anvil cylinder. As the portion of the band saw blade used in cutting the paper degrades, the tensioning apparatus, together with an appropriate advancing mechanism, is used to advance the band saw blade, so that the degraded portion of the band saw blade is wound around the receiving post and an equal portion of undegraded band saw blade is unwound from the supplying post. This advancing can be accomplished with the cutting machine stopped, or during operation of the cutting machine. The advancing of the band saw blade occurs between cuts, when the cut cylinder is disengaged from the anvil cylinder. The advancing can be repeated while the machine is running until the entire length of the band saw blade has degraded.

In another embodiment, the plurality of cut rubber strips placed radially around the anvil cylinder may be replaced by a single cut rubber surface placed circumferentially around the entire outer circumference of the anvil cylinder. Because the anvil cylinder is stationary through the paper cutting process, the same portion of the single cut rubber surface engages the knife box affixed to the cut cylinder upon each complete rotation of the cut cylinder. If this portion of the single cut rubber surface degrades, anvil cylinder can be circumferentially rotated by an advancing or indexing mechanism that an unused portion of the single cut rubber surface will engage the knife box affixed to the cut cylinder upon each complete rotation of the cut cylinder.

This indexing can be accomplished with the cutting machine stopped or on the run. The indexing can be repeated while the machine is running until the entire cut rubber surface has degraded.

DETAILED DESCRIPTION OF THE INVENTION

Figure 1A:
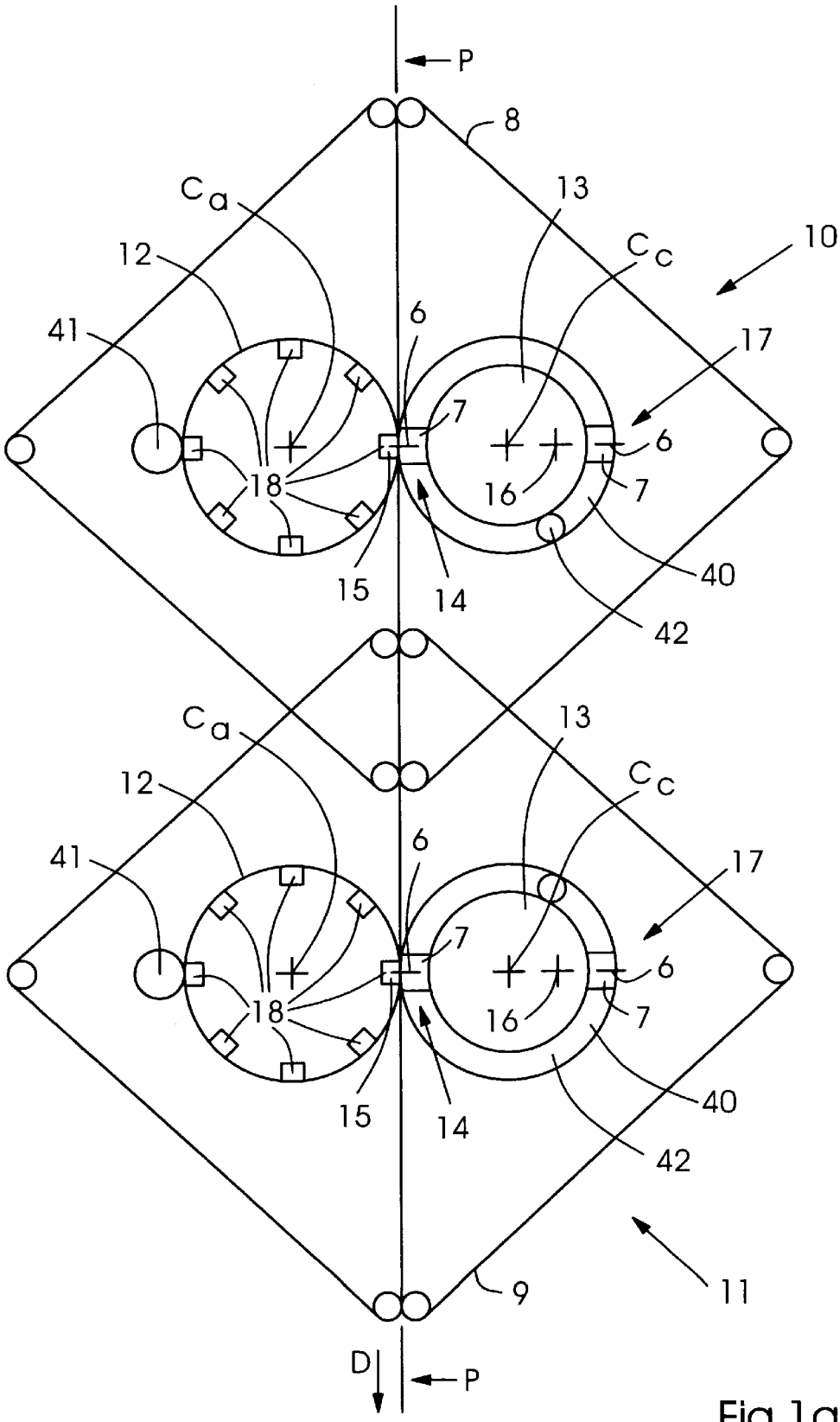
FIG. 1*a* shows an end elevation view of an embodiment of the present invention, performing a double cut process, in a cutting position.
Figure 1B:
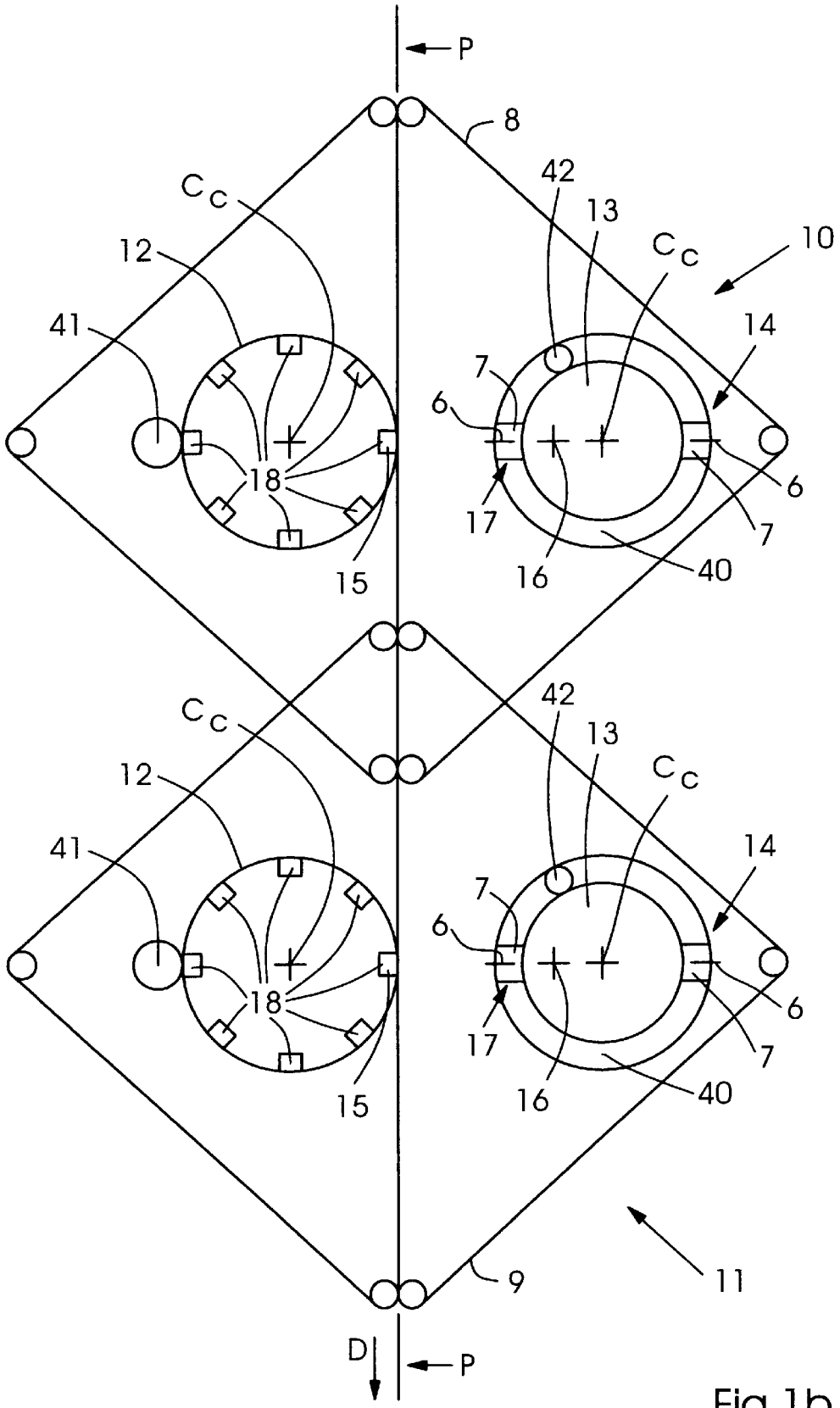
FIG. 1*b* shows an end elevational view of the embodiment of FIG. 1*a*, in a non-cutting position.

FIGS. 1*a* and 1*b* show a cutting apparatus for a double cut process with an upper cutting set 10 and a lower cutting set 1l. Material, e.g. a web of paper P is fed in direction through upper cutting mechanism 8 and lower cutting mechanism 9. A paper tape may guide the paper P between an anvil cylinder 12 and a cut cylinder 13. A primary knife box 14 and a reserve knife box 17 are spaced circumferentially around the cut cylinder 13 on a knife sleeve 40. In a preferred embodiment, two knife boxes 14, 17 are used opposite one another. However, any number of reserve knife boxes 17 could be spaced around the circumference of knife sleeve 40. Knife sleeve 40 is mounted so that it may rotate about cut cylinder center $C_c$, relative to cut cylinder 13. Both primary knife box 14 and reserve knife box 17 are composed of a blade 6 with surrounding cheekwood 7, which cheekwood 7 secures the blade 6 to cut cylinder 13 contacts the cut rubber strips 15, 18 during cutting. A primary cut rubber strip 15 and a plurality of reserve cut rubber strips 18 are placed circumferentially around the anvil cylinder 12 in equal spaced intervals.

As the paper is fed between the anvil cylinder 12 and the cut cylinder 13, the cut cylinder 13 rotates about an eccentric axis 16. The anvil cylinder 12 is held stationary. As the cut cylinder 13 rotates, knife 6 from the primary knife box 14 moves toward anvil cylinder 12 and cuts the paper P threaded between the cut cylinder 13 and the anvil cylinder 12 at regular intervals, determined by the speed at which paper P is fed and the speed at which cut cylinder 13 rotates about eccentric axis 16. While the knife 6 from primary knife box 14 is cutting the paper P (FIG. 1*a*), knife 6 from the primary knife box 14 also engages the opposing primary cut rubber 15 on the anvil cylinder 12. Because the cut cylinder 13 rotates about an eccentric axis 16, the reserve knife box 17 does not cut the paper or engage the primary cut rubber 15 (FIG. 1*b*).

When the knife 6 or cheekwood 7 of the primary knife box 14 degrades, the knife sleeve 40 is rotated about cut cylinder axis $C_c$ relative to cut cylinder 13 by one half of a revolution (in the embodiment of FIGS. 1*a* and 1*b*, using one primary knife box 14 and one reserve knife box 17) such that the reserve knife box 17 takes the place of the primary knife box 14. The knife sleeve 40 is then fixed to the cut cylinder 13 to prevent relative rotation between the two. When the primary cut rubber strip 15 degrades, the anvil cylinder 12 is circumferentially rotated about anvil cylinder axis $C_a$ an index such that a reserve cut rubber strip 18 takes the place of the primary cut rubber strip 15. Either of these steps can be accomplished while the cutting machine is stopped, or while the machine is running. If these steps are accomplished while the machine is running, the reserve knife box 17 or reserve cut rubber strip 15 is indexed when the cut cylinder 13 is disengaged from the anvil cylinder 12 (i.e., in the position shown in FIG. 1*a*).

In the embodiment shown in FIGS. 1*a* and 1*b*, the reserve cut rubbers 18 are indexed into position using an indexing mechanism 41. Indexing mechanism 41 can be any known mechanism for indexing a cylinder through angular rotation, such as a motor to the frame of cutting mechanism 8, 9, which motor has a gear which mates with a gear fixed on anvil cylinder 12, or alternatively a motor fixed to anvil cylinder 12, which motor has a gear which mates with a gear fixed on the frame of cutting mechanism 8, 9 . Similarly, the reserve knife box 17 can be indexed into position using an indexing mechanism 42. Indexing mechanism 41 can be any known mechanism for indexing a sleeve through angular rotation, such as a motor fixed either to the cut cylinder 13 or knife sleeve 40, which motor has a gear which mates with a gear fixed either on knife sleeve 40 or cut cylinder 13.

Figure 2:
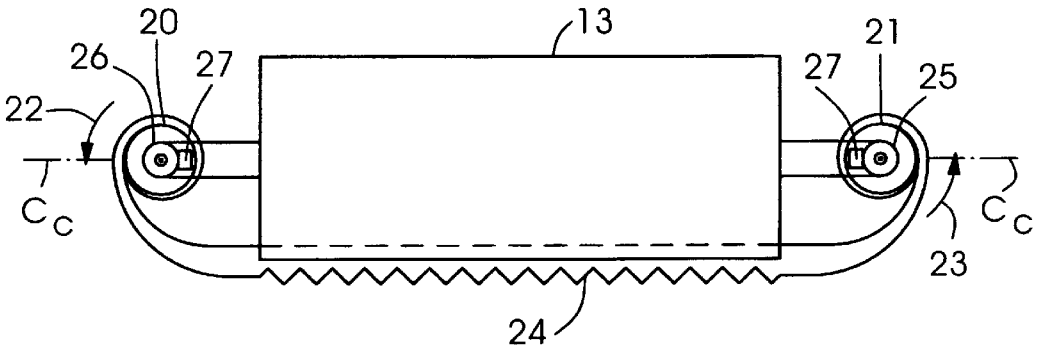
FIG. 2 shows a side elevational view of a cut cylinder of a second embodiment of the present invention.

FIG. 2 shows another embodiment of the cut cylinder of present invention. A band saw blade 24 installed on the cut cylinder 13, running along the length of the cut cylinder 13 between cheekwoods 7 (not shown). The band saw blade 24 takes the place of the primary knife box 14 and the reserve knife box 17 of the embodiment of FIGS. 1*a* and 1*b*. A supplying post 20 is fixed axially outward from the center of one end of the cut cylinder 13 and a receiving post 21 is fixed axially outward from the center of the other end of the cut cylinder 13. A tensioning apparatuses 25 and/or 26, for example, one or more torsional springs or any other known mechanism for providing tension in an elongated flexible member, are applied to posts 20 and/or 21 and/or saw blade 24. The tensioning apparatuses 25 and/or 26 ensure that the band saw blade 24 is wound around the supply post 20 and the receiving post 21 while running down the outside surface of the cut cylinder 13, in tension, approximately parallel to the axis of the cut cylinder 13. Initially, most of the band saw blade 24 is wound around the supplying post 20. An advancing mechanism 27, such as a ratchet or any other known mechanism for selectively securing the band saw blade 24 against unwinding, may be located at either post 20 or 21 to control advancement of saw blade 24.

In the embodiment of FIG. 2, band saw blade 24 serves the same function as knife 6 of the primary knife box 14 in cutting the paper and engaging the primary cut rubber strip 15 of the anvil cylinder 12. After the portion of band saw blade 24 engaged in the cutting of the paper P degrades, the advancing apparatus 27 is released, causing tensioning apparatuses 25 and/or 26 to advance band saw blade 24 in the direction by arrows 22 and 23. The advancing of band saw blade 24 is such that the degraded portion of the band saw blade 24 is wound around the receiving post 21 and an equal portion of the unused band saw blade 24 is released from around the supplying post 21. Once the advancing is complete, the advancing mechanism 27 is engaged, to hold the band saw blade 24 in place. This advancing can be accomplished with the cutting machine stopped or running.

Figure 3:
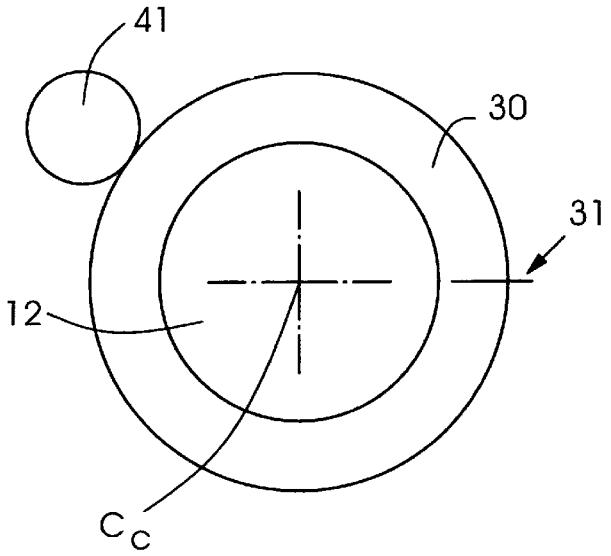
FIG. 3 shows an end elevational view of an anvil cylinder of a third embodiment of the present invention.

FIG. 3 shows another embodiment of the anvil cylinder of the present invention, where a single cut rubber surface or sleeve 30 placed radially around the entire circumference of the anvil cylinder 12. In this embodiment, the single cut rubber surface 30 takes the place of the primary cut rubber strip 15 and the reserve cut rubber strips 18. Because the anvil cylinder 12 is stationary through the paper cutting process, the same portion 31 of the single cut rubber surface 30 is engaged by the blade of the cut cylinder 13 upon each complete rotation of the cut cylinder 13. After this portion 31 of the single cut rubber surface 30 degrades, the anvil cylinder 12 is rotated about anvil cylinder axis $C_a$ through an angle such that a unused portion of the single cut rubber surface 30 is engaged by the blade of the cut cylinder 13 upon each complete rotation of the cut cylinder 13. This rotation can be accomplished with the cutting machine stopped or on the run, and is continued until the entire cut rubber surface 30 is degraded.

As will be appreciated by one of ordinary skill in the art, the embodiments disclosed herein are not meant to be exclusive. In particular, but without limiting other variations, the preferred embodiment disclosed involves the use of paper fed by two paper tapes through two sets of cylinders, but the present invention could be used for the threading of any material through one or more sets of cutting or anvil cylinders. It is the claims which define the scope of the present invention.

What is claimed is:

1. A cutting apparatus, comprising:

an anvil cylinder, the anvil cylinder being mounted for rotation;

at least one cut rubber located on the outer surface of the anvil cylinder;

a cut cylinder, the cut cylinder being mounted for rotation about an eccentric axis;

at least one knife blade mounted on an outer surface of the cut cylinder, the knife blade contacting the at least one cut rubber during rotation of the cut cylinder;

a plurality of knife boxes, the at least one knife blade including a plurality of knife blades, each of the plurality of knife blades being mounted in one of the knife boxes, and a knife sleeve mounted for rotation on an outer surface of the cut cylinder, the plurality of knife boxes being mounted on the knife sleeve.

2. The cutting apparatus of claim 1, wherein:

the at least one cut rubber includes a plurality of cut rubber strips spaced around a circumference of the anvil cylinder.

3. The cutting apparatus of claim 1, wherein:

the at least one cut rubber includes a cut rubber sleeve mounted on the outer surface of the anvil cylinder.

4. The cutting apparatus of claim 1, further comprising:

an indexing mechanism, the indexing mechanism rotating the knife sleeve relative to the cut cylinder.

5. A cutting apparatus, comprising:

at least one cut rubber;

a cut cylinder, the cut cylinder being mounted for rotation about an eccentric axis;

at least one knife blade mounted on an outer surface of the cut cylinder, the knife blade contacting the at least one cut rubber during rotation of the cut cylinder;

a plurality of knife boxes, the at least one knife blade including a plurality of knife blades, each of the plurality of knife blades being mounted in one of the knife boxes; and a knife sleeve mounted for rotation on an outer surface of the cut cylinder, the plurality of knife boxes being mounted on the knife sleeve.

6. The cutting apparatus of claim 5 further comprising:

an anvil cylinder, the at least one cut rubber being mounted on the anvil cylinder.

7. The cutting apparatus of claim 6, wherein:

the at least one cut rubber includes a plurality of cut rubber strips spaced around a circumference of the anvil cylinder.

8. The cutting apparatus of claim 6, wherein:

the at least one cut rubber includes a cut rubber sleeve mounted on the outer surface of the anvil cylinder.

9. The cutting apparatus of claim 5, further comprising:

an indexing mechanism, the indexing mechanism rotating the knife sleeve relative to the cut cylinder.

10. A cutting apparatus, comprising:

at least one cut rubber;

a cut cylinder, the cut cylinder being mounted for rotation about an eccentric axis;

at least one knife blade mounted on an outer surface of the cut cylinder, the knife blade contacting the at least one cut rubber during rotation of the cut cylinder; and a knife sleeve mounted for rotation on an outer surface of the cut cylinder, the at least one knife blade being mounted on the knife sleeve.

11. The cutting apparatus of claim 10, further comprising:

a plurality of knife boxes, the at least one knife blade including a plurality of knife blades, each of the plurality of knife blades being mounted in one of the knife boxes.

12. The cutting apparatus of claim 10, further comprising:

an indexing mechanism, the indexing mechanism rotating the knife sleeve relative to the cut cylinder.

13. A method for cutting, comprising:

providing at least one cut rubber;

mounting a cut cylinder for rotation about an eccentric axis, the cut cylinder including at least one knife blade mounted an outer surface of the cut cylinder, wherein the at least one knife blade is movably mounted on the cut cylinder;

rotating the cut cylinder so that at least one knife blade contacts the at least one cut rubber during rotation of the cut cylinder;

mounting a knife sleeve for rotation on an outer surface of the cut cylinder;

mounting a plurality of knife blades on the knife sleeve; and moving the at least one knife blade from a cutting position to a non-cutting position on the cut cylinder by rotating the knife sleeve.

* * * * *